US010427023B2

(12) United States Patent
Piombino et al.

(10) Patent No.: US 10,427,023 B2
(45) Date of Patent: Oct. 1, 2019

(54) SHOULDER PADS AND METHOD OF MANUFACTURING THE SAME

(71) Applicant: BSN SPORTS, LLC, Farmers Branch, TX (US)

(72) Inventors: Don Piombino, Farmers Branch, TX (US); Bastien Jourde, Montréal (CA)

(73) Assignee: BSN SPORTS, LLC, Farmers Branch, TX (US)

( * ) Notice: Subject to any disclaimer, the term of this patent is extended or adjusted under 35 U.S.C. 154(b) by 130 days.

(21) Appl. No.: 15/484,701

(22) Filed: Apr. 11, 2017

(65) Prior Publication Data

US 2017/0296903 A1 Oct. 19, 2017

Related U.S. Application Data

(60) Provisional application No. 62/323,316, filed on Apr. 15, 2016.

(51) Int. Cl.

*A41D 13/015* (2006.01)
*A63B 71/12* (2006.01)
*A41D 13/05* (2006.01)

(52) U.S. Cl.

CPC ..... *A63B 71/12* (2013.01); *A41D 13/0153* (2013.01); *A41D 13/0512* (2013.01); *A63B 2071/1208* (2013.01)

(58) Field of Classification Search

CPC ..... A61F 5/0125; A61F 2/4425; A63B 71/12; A63B 2071/1208; A63B 2243/007; A63B 2102/24; A41D 13/0153; A41D 13/05; A41D 13/0512

See application file for complete search history.

(56) References Cited

U.S. PATENT DOCUMENTS

| | | | | |
|---|---|---|---|---|
| 759,833 A | | 5/1904 | Stall | |
| 2,266,886 A | | 12/1941 | McCoy | |
| 4,035,844 A | | 7/1977 | Atack et al. | |
| 4,486,901 A | | 12/1984 | Donzis | |
| 4,513,449 A | | 4/1985 | Donzis | |
| 4,817,588 A | * | 4/1989 | Bledsoe | A61F 5/0125 602/16 |

(Continued)

OTHER PUBLICATIONS

LEATT Product, 2012.
Acerbis Product, 2011.
Bike Athletic Company, Catalog, Oct. 2002, pp. 2-8.

*Primary Examiner* — Robert H Muromoto, Jr.
(74) *Attorney, Agent, or Firm* — Finnegan, Henderson, Farabow, Garrett & Dunner, L.L.P.

(57) ABSTRACT

The invention is to shoulder pads having arches that are pivotably connected to the chest and back portions of the pads to give an increased range of motion for a user. The arch is connected with a single pivoting connection on the chest portion and a single pivoting connection on the back portion so that the arch pivots relative to the chest and back portions of the shoulder pads. The arch portions of the pads are manufactured by injection molding so that the arches maintain their arch shape without the need for structural components to maintain its shape. The invention also includes a buckle system for shoulder pads that provide an easy mechanism for a user to adjust and to take the pads on and off. The buckle system provides a generally flush mount which reduces and preferably eliminates any grab points.

10 Claims, 11 Drawing Sheets

(56) References Cited

U.S. PATENT DOCUMENTS 5,000,169 A * 3/1991 Swicegood ..... A61F 5/0125 128/882
5,052,379 A * 10/1991 Airy ..... A61F 5/0125 482/112
5,292,303 A * 3/1994 Bastyr ..... A61F 5/0125 602/16
5,399,154 A * 3/1995 Kipnis ..... A61F 5/0125 602/16
5,409,449 A * 4/1995 Nebolon ..... A61F 5/0125 16/333
5,437,611 A * 8/1995 Stern ..... A61F 5/0125 482/124
5,443,444 A * 8/1995 Pruyssers ..... A61F 5/0123 602/16
5,460,599 A * 10/1995 Davis ..... A61F 5/0125 602/16
5,701,611 A 12/1997 Rector et al.
5,781,935 A 7/1998 Bassett et al.
5,814,000 A * 9/1998 Kilbey ..... A61F 5/0125 602/16
5,920,915 A 7/1999 Bainbridge et al.
5,997,493 A * 12/1999 Young ..... A61F 5/0125 602/16
6,032,300 A 3/2000 Bainbridge et al.
6,245,034 B1 * 6/2001 Bennett ..... A61F 5/0125 602/16
D448,484 S * 9/2001 Bradshaw ..... D24/155
6,336,220 B1 1/2002 Sacks et al.
6,383,156 B1 * 5/2002 Enzerink ..... A61F 5/0125 602/16
6,527,733 B1 * 3/2003 Ceriani ..... A61F 5/0123 602/16
6,623,439 B2 * 9/2003 Nelson ..... A61F 5/0123 128/882
6,845,522 B2 1/2005 Beland
6,878,126 B2 * 4/2005 Nelson ..... A61F 5/0123 128/882
6,880,269 B2 4/2005 Falone et al.
6,993,808 B1 * 2/2006 Bennett ..... A61F 5/0125 16/321
7,037,287 B2 * 5/2006 Cormier ..... A61F 5/0125 602/16
7,044,926 B2 * 5/2006 Carlson ..... A61F 5/0125 602/16
7,097,627 B2 * 8/2006 Enzerink ..... A61F 5/0125 602/23
7,128,723 B2 * 10/2006 Doty ..... A61F 5/0123 602/16
7,168,104 B2 1/2007 Tobergte
7,235,058 B2 * 6/2007 Doty ..... A61F 5/0123 602/16
7,235,059 B2 * 6/2007 Mason ..... A61F 5/0125 128/882
D550,930 S * 9/2007 Davila, Sr. ..... D2/840
D553,299 S * 10/2007 Le Carpentier ..... D29/101.2
7,306,572 B2 * 12/2007 Ceriani ..... A61F 5/0123 602/16
7,389,547 B1 6/2008 Wiens
7,438,845 B2 * 10/2008 McVicker ..... B29C 45/33 264/318
7,534,220 B2 * 5/2009 Cormier ..... A61F 5/0125 135/141
7,662,119 B2 * 2/2010 DeToro ..... A61F 5/0125 602/16
7,722,555 B2 * 5/2010 Doty ..... A61F 5/0123 602/16
7,752,679 B2 * 7/2010 Romero ..... A41D 13/0568 2/24
7,833,181 B2 * 11/2010 Cormier ..... A61F 5/0125 128/882
7,841,999 B2 * 11/2010 Napholz ..... A61F 5/0123 602/16
D633,688 S 3/2011 Turner
7,984,531 B2 * 7/2011 Moore ..... A61F 5/0125 16/326
7,988,653 B2 * 8/2011 Fout ..... A61F 5/013 24/593.1
8,062,242 B2 * 11/2011 Ceriani ..... A61F 5/0123 602/16
8,141,169 B2 * 3/2012 Saranga ..... A41D 13/065 2/22
8,172,781 B2 * 5/2012 Oddou ..... A61F 5/0125 128/846
D662,690 S * 7/2012 Peoples ..... D2/731
8,273,045 B2 * 9/2012 Ceriani ..... A61F 5/0125 128/846
D668,021 S * 10/2012 Peoples ..... D2/731
8,277,403 B2 * 10/2012 Ceriani ..... A61F 5/0125 128/846
D671,690 S * 11/2012 Brady ..... D29/120.1
8,517,965 B2 * 8/2013 Doty ..... A61F 5/0123 128/846
D693,930 S * 11/2013 Manalo ..... D24/190
8,591,444 B2 * 11/2013 Bejarano ..... A61F 5/0125 602/16
8,657,767 B2 * 2/2014 Chan ..... A61F 5/0127 128/846
8,763,977 B2 * 7/2014 Huang ..... F16M 11/10 16/326
9,161,872 B2 * 10/2015 Lee ..... A61G 7/1015
9,458,878 B2 * 10/2016 Scatassa ..... A61F 5/0102
D813,089 S * 3/2018 Frost ..... D11/218
9,925,082 B2 * 3/2018 Chetlapalli ..... A61F 5/0123
D835,289 S * 12/2018 Frost ..... D24/190
2004/0154083 A1 * 8/2004 McVicker ..... A41D 13/05 2/455
2015/0013052 A1 * 1/2015 Kraemer ..... A63B 71/12 2/459

* cited by examiner

| Shoulder Pads | | |
|---|---|---|
| **Process** | **Step** | |
| **Part 1: Plastic** | 1. Injection | Arch Plate, Lower Front Plate, Buckle, Lower Back Plate, Epaulet, Bicep Cap, Strap Cover |
| | 2. Die-cutting & Trimming | Inner Plastic Plate |
| | 3. Foil Stamping | Arch Plate, Epaulet, Bicep Cap |
| **Part 2: Padding & Assembly** | 1. Die-cutting | Fabric & EVA |
| | 2. Gluing | Neck Padding, Arch Padding, Epaulet Padding, Bicep Padding |
| | 3. Compression | Removable Liner |
| | 4. Sewing | Bottom Fabric for Arch Padding, Top Fabric for Front and Back Lower Padding, Front and Back Connector, Velcro |
| | 5. Gluing | Arch Padding Blocks, Front and Back Connector Pad, Removable Pad, Clavicle Channel |
| | 6. Binding Sewing | Arch Padding, Shoulder Area Padding, Connector Fabric & Accessories |
| | 7. Sewing | Connector Fabric for Arch Padding and Front & Back Lower Pad, Bottom Fabric for Arch Padding, Neck Pad |
| | 8. Rivet Punching | Arch Plate, Lower Front Plate, Buckle, Lower Back Plate, Epaulet, Bicep Cap, Strap Cover |

FIG. 11

SHOULDER PADS AND METHOD OF MANUFACTURING THE SAME

CROSS-REFERENCE TO RELATED APPLICATIONS

This application is based upon and claims the benefit of priority from U.S. Provisional Application No. 62/323,316 filed Apr. 15, 2016; the entire contents of which is incorporated herein by reference.

FIELD OF THE INVENTION

This invention relates to an improved athletic protective pad construction that provides dynamic range of motion (mobility), superior protection, moisture management properties, advanced impact dispersion properties, and improved comfort. The pad construction is lightweight and breathable. The invention also relates to buckle systems that are less bulky and easy to use. The features described in this invention can be incorporated into shoulder pads used in at least the following activities: football, motocross, lacrosse, and hockey.

BACKGROUND

Shoulder pads are used in a variety of sports for protection from impact such as football, motocross, lacrosse and hockey. Football shoulder pads typically include front, back and shoulder portions in an integrated manner. A rigid arch portion made of plastic that extends from the front portion to the back portion is used to provide stability to the shoulder portions. U.S. Pat. No. 7,168,104 discloses an arch portion that is rigidly attached to the shoulder pads on the front, back and shoulder portions using numerous rivets at numerous locations throughout the arch. Due to the integrated manner of the shoulder portions to the back and front portions of the shoulder pads and to the rigid arch on the shoulder portion, a user has a restricted range of motion.

Shoulder pad arches are conventionally plastic materials formed by compression molding. After compression molding, the materials are heated to bend the component into an arch. Due to the compression molding and bending, over time the arch tends to straighten out. Conventionally, arches are rigidly secured to the shoulder pads by numerous rivets at numerous locations to prevent this tendency for compression molded arches to straighten out.

Conventional shoulder pads also include buckles for securing shoulder pads on a user. However, conventional buckles are bulky and provide easy grab points for, e.g., football opponents, to grab onto.

SUMMARY

The invention provides shoulder pads having arches that are pivotably connected to the chest and back portions of the pads to give an increased range of motion for a user. The arch is connected with a single pivoting connection on the chest portion and a single pivoting connection on the back portion so that the arch pivots relative to the chest and back portions of the shoulder pads. The arch portions of the pads are manufactured by injection molding so that the arches maintain their arch shape without the need for structural components in addition to the single pivoting connection to maintain their shape.

The invention also includes a buckle system for shoulder pads that provide an easy mechanism for a user to adjust and to take the pads on and off. The buckle system provides a generally flush mount which reduces and preferably eliminates any grab points.

A first aspect of the invention is shoulder pads comprising: a left and a right torso pad, each including a front portion, a back portion, and an arch portion; wherein a front end of each arch portion is pivotably connected to the respective front portion by a single fastener, a back end of each arch portion is pivotably connected to the respective back portion by a single fastener, and the pivotable connections allow each arch portion to rotate independently with respect to respective chest and back portions.

In a second aspect of the invention, the shoulder pads further comprise a shoulder portion that is fastened to each arch portion and is pivotably connected to respective front portions and back portions at the same pivotable connection as the respective arch portion.

In a third aspect of the invention, each arch portion includes additional connections to respective front and back portions by a flexible material that does not inhibit pivotability of the arch portion at the pivotable connections.

In a fourth aspect of the invention, the range of rotation of the arch portions is 10-20 degrees.

In a fifth aspect of the invention, the pivotable connections are rotatable rivets.

In a sixth aspect of the invention, the arch portions are plastic components that are injection molded in an arch shape.

In a seventh aspect of the invention, the arch portions comprise fiberglass, and polyethylene or polypropylene, and the amount of fiberglass is 5-15% by weight.

An eighth aspect of the invention is a buckle system for shoulder pads comprising: a buckle; and a receiving portion for receiving and securely engaging the buckle, the buckle comprising: a tongue portion at a front end of the buckle; an L-shaped middle protrusion on a bottom surface of the buckle and at the middle of the buckle, and left and right L-shaped side protrusions on the bottom surface of the buckle, the left L-shaped side protrusion being arranged on a left side of the L-shaped middle protrusion with respect to the front side of the buckle, and the right L-shaped side protrusion being arranged on a right side of the L-shaped middle protrusion with respect to the front side of the buckle; wherein the L-shaped middle protrusion protrudes orthogonally from the bottom surface of the buckle and at an end of the L-shaped middle protrusion opposite the bottom surface of the buckle, the middle protrusion has an approximately 90° bend towards a back end of the buckle opposite the front end of the buckle, and wherein the left and right L-shaped side protrusions protrude orthogonally from the bottom surface of the buckle and at an end of the left and right side protrusions opposite the bottom surface of the buckle, the left and right L-shaped side protrusions have an approximately 90° bend toward a respective left and right side of the buckle in opposite directions and away from the L-shaped middle protrusion; and the receiving portion comprising: a front wall and two side walls connected to the front wall to form a cavity in substantially the same outer peripheral shape of the front end of the buckle and two sides of the buckle adjacent to the front end of the buckle for receiving the buckle; a slot formed in the cavity at a front end of the cavity for receiving the tongue portion of the buckle; and a stepped cut-out formed in the cavity, the stepped cut-out having a wide portion for receiving the L-shaped middle protrusion and left and right side protrusions of the buckle, and a narrower portion arranged in a direction opposite from the front wall of the cavity for engaging with the L-shaped middle protrusion and left and right side protrusions to secure the buckle to the receiving portion.

BRIEF DESCRIPTION OF THE DRAWINGS

FIG. 7A is a side perspective view of the buckle; FIG. 7B is a bottom view of the buckle; FIG. 7C is a top perspective view of the buckle;

FIG. 11 is a table demonstrating the process for manufacturing shoulder pads in accordance with one embodiment of the invention;

DETAILED DESCRIPTION

Figure 1:
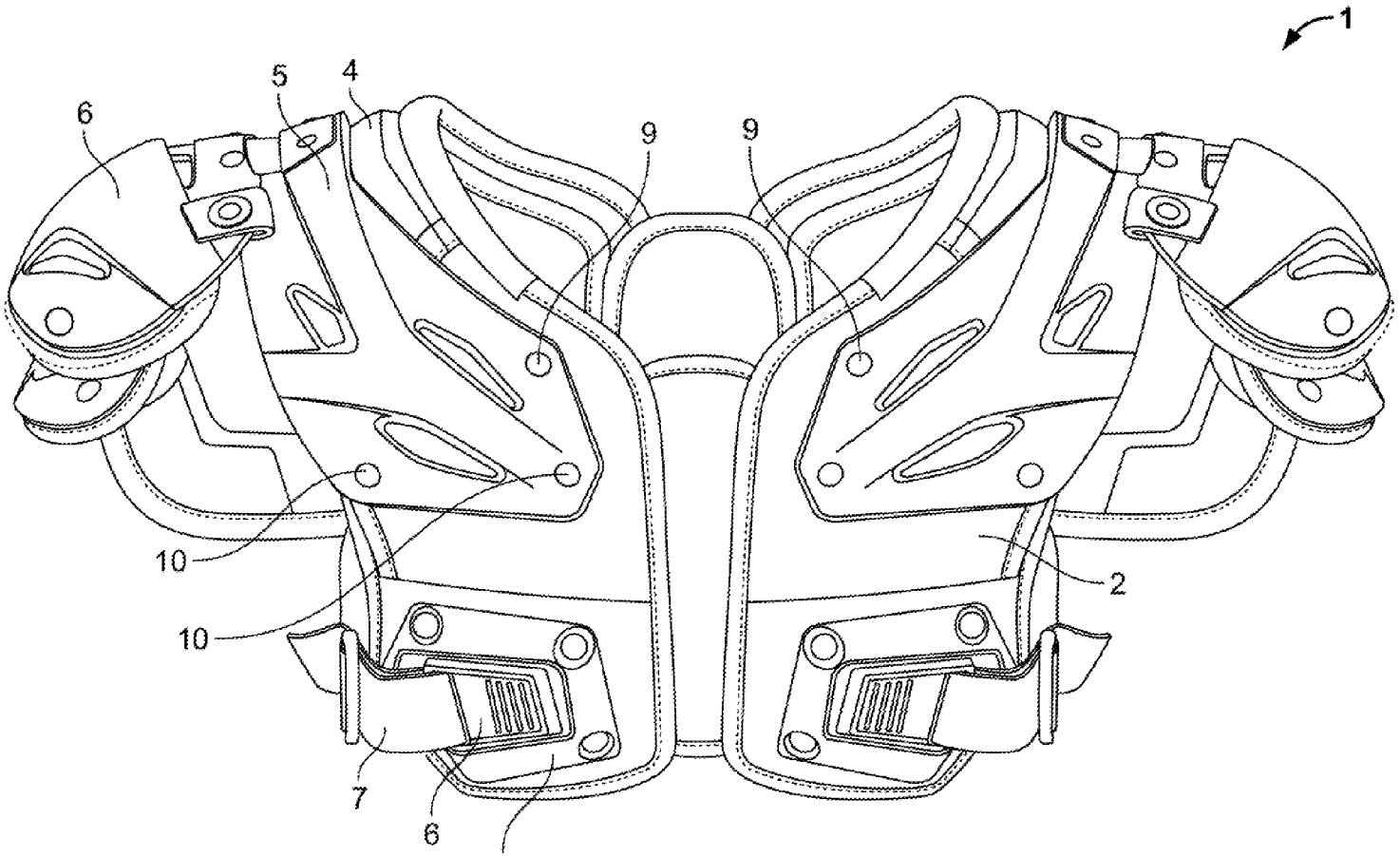
FIG. 1 is a front perspective view of football shoulder pads in accordance with one embodiment of the invention.
Figure 2:
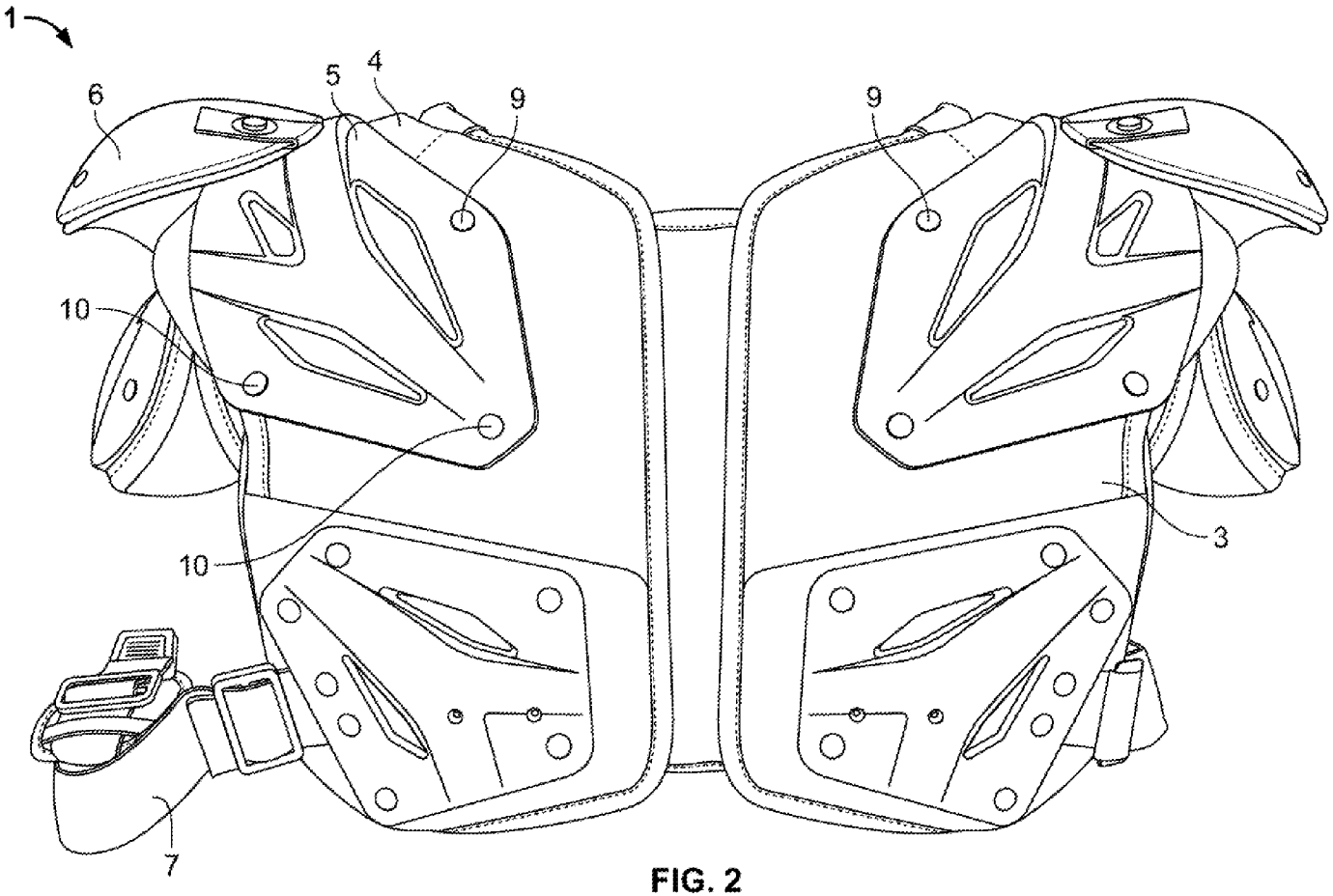
FIG. 2 is a back perspective view of football shoulder pads in accordance with one embodiment of the invention.
Figure 3:
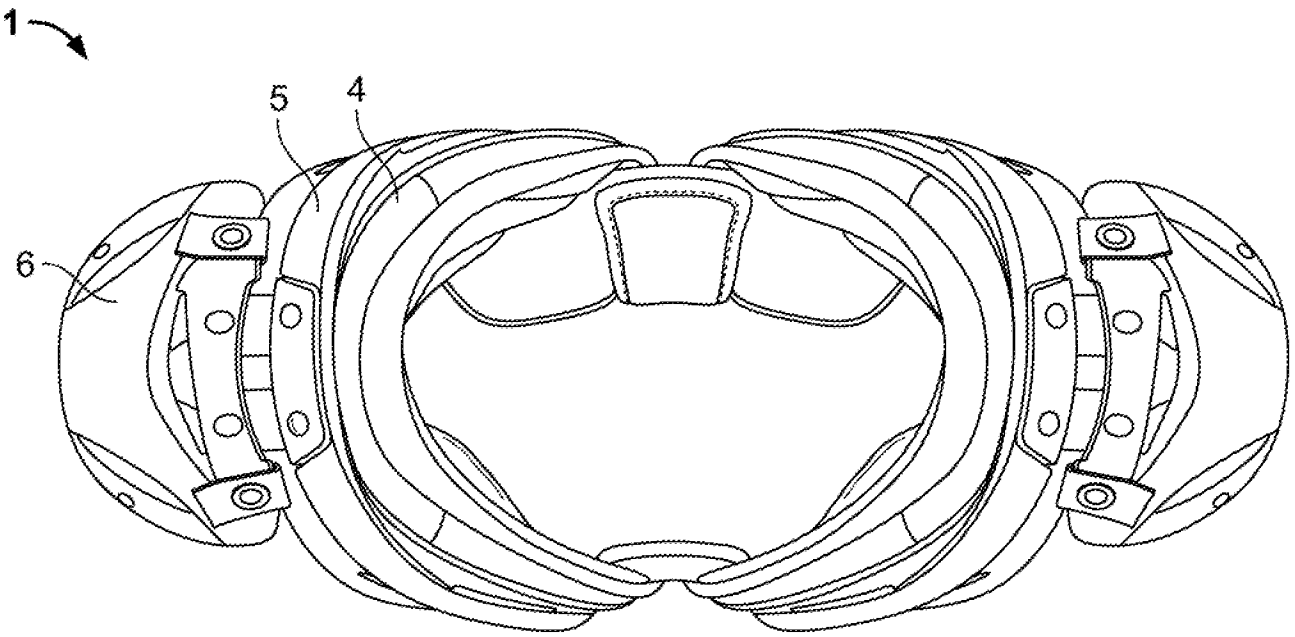
FIG. 3 is a top perspective view of football shoulder pads in accordance with one embodiment of the invention.

Shoulder pads in accordance with the invention are, for example, football shoulder pads as shown in FIGS. 1-3. The shoulder pads 1 include left and right torso halves. Each half is a mirror image of the other and includes a chest portion 2, back portion 3 and shoulder portion 4. The shoulder pads 1 include arch portions 5 that extend partially over the exterior of each torso half. The arch portions 5 are made of a rigid plastic and the arch portions 5 connect to the chest portions 2 and the back portions 3 and form an arch from the chest portions 2 to the back portions 3. Shoulder cap pads 6 are connected to the arch portions 5.

FIG. 1 shows a front view of the shoulder pads 1 which include the chest portion 2 and the arch portion 5 connected to the chest portion 2. A buckle system 12 is provided on each torso half which includes a belt 7 for securing the shoulder pads to a user. The belt 7 is attachable and detachable from the chest portion 2 via the buckle system 12 and the belt 7 is attached to the back portion 3. FIG. 2 shows a back view of the shoulder pads 1 which includes the back portion 3 and the arch portions 5 connected to the back portions 3. This view also shows attachment of the belt 7 to the back portion 3 with the belt 7 detached from the chest portion 2. FIG. 3 provides a top view of the shoulder pads 1 which includes a top view of the arch portion 5 and also shows the top of the shoulder cap pads 6.

Figure 4:
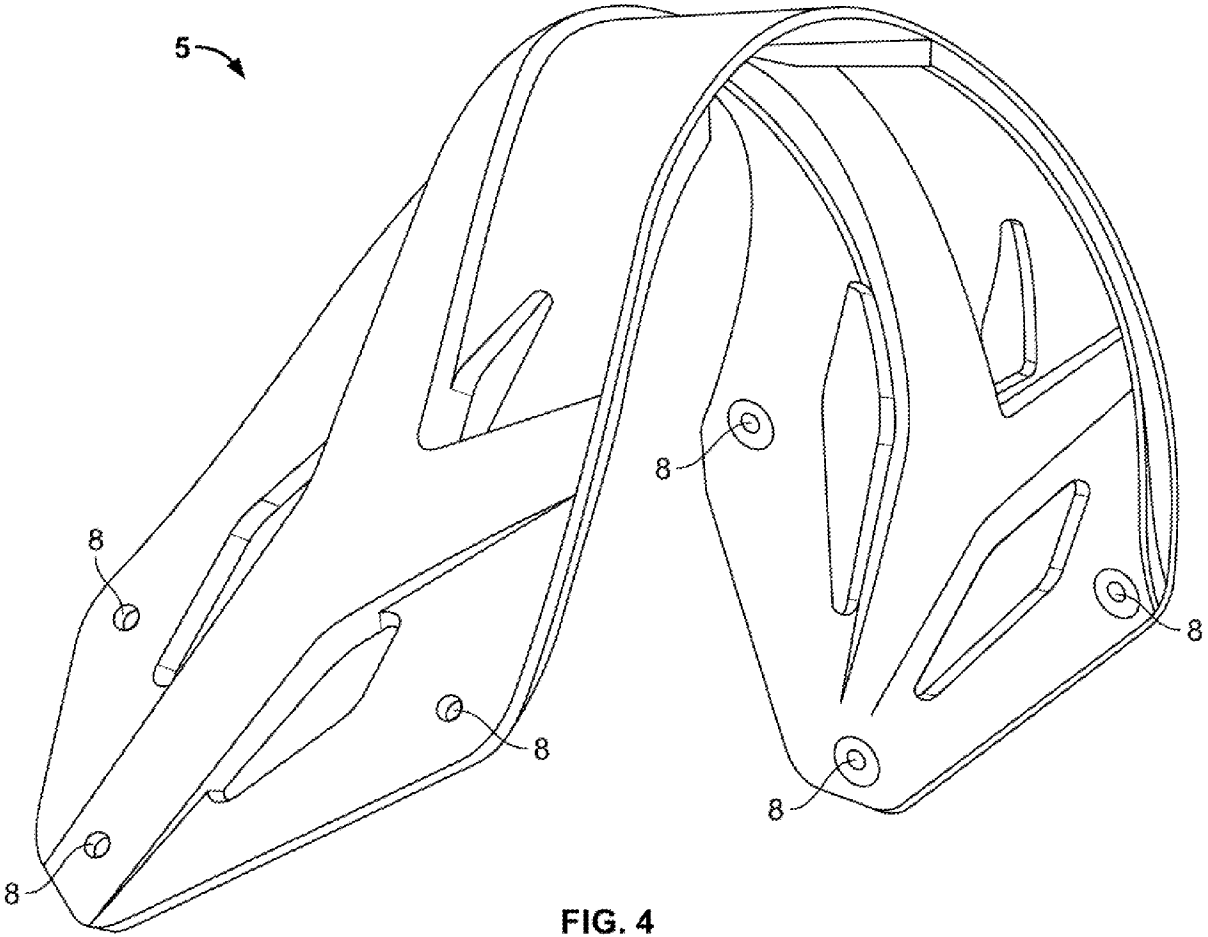
FIG. 4 is an enlarged perspective view of the arch portion of football shoulder pads in accordance with one embodiment of the invention.

The arch portions 5 are connected to the torso portions in a manner that provides dynamic range of motion. In one embodiment, the arch portion 5 is a one-piece molded component connected to the shoulder pad 1 with pivot points and is stabilized with stretch components. A view of the arch portion 5 separate from the shoulder pads is shown in FIG. 4. The arch portion 5 has three holes 8 on each end of the arch for engaging fastening devices such as rivets, and the holes are arranged in a generally triangular pattern. In FIGS. 1 and 2, the arch portion 5 is shown with rivets in holes 8 of arch portion 5. A single pivot rivet 9 at one point of the triangle on each end of the arch is structurally secured to the shoulder pads 1. The pivot rivet 9 is configured to rotate in a larger hole (e.g., to allow movement). The pivot rivet 9 that structurally secures the arch portion 5 to the chest portion 2 and the pivot rivet 9 that structurally secures the arch portion 5 to the back portion 3 act as pivots so that the arch portion 5 can rotate with respect to the chest and back portions (2, 3) of the shoulder pads. The remaining rivets on the arch portion 5 are stabilizing rivets 10 that stabilize the arch portion 5 via stretch components and do not inhibit the rotation of the arch at the pivot points (pivot rivet 9). The arch portions 5 are not firmly attached to the chest portions 2 or back portions 3 as in conventional pads. The arch portions 5 rotate independently from these connection points.

In addition the shoulder portion 4 of the shoulder pads is fastened to the arch portion 5 by, e.g., rivets. The shoulder portion 4 is also fastened to the chest and back portions (2, 3) of the pads at the same single pivot point (pivot rivet 9) as the arch portion 5 and is provided between the arch portion 5 and the chest/back portions (2, 3). Thus, the shoulder portion 4 of the pads pivots with the arch portion 5 relative to the chest and back portions (2, 3).

Figure 5:
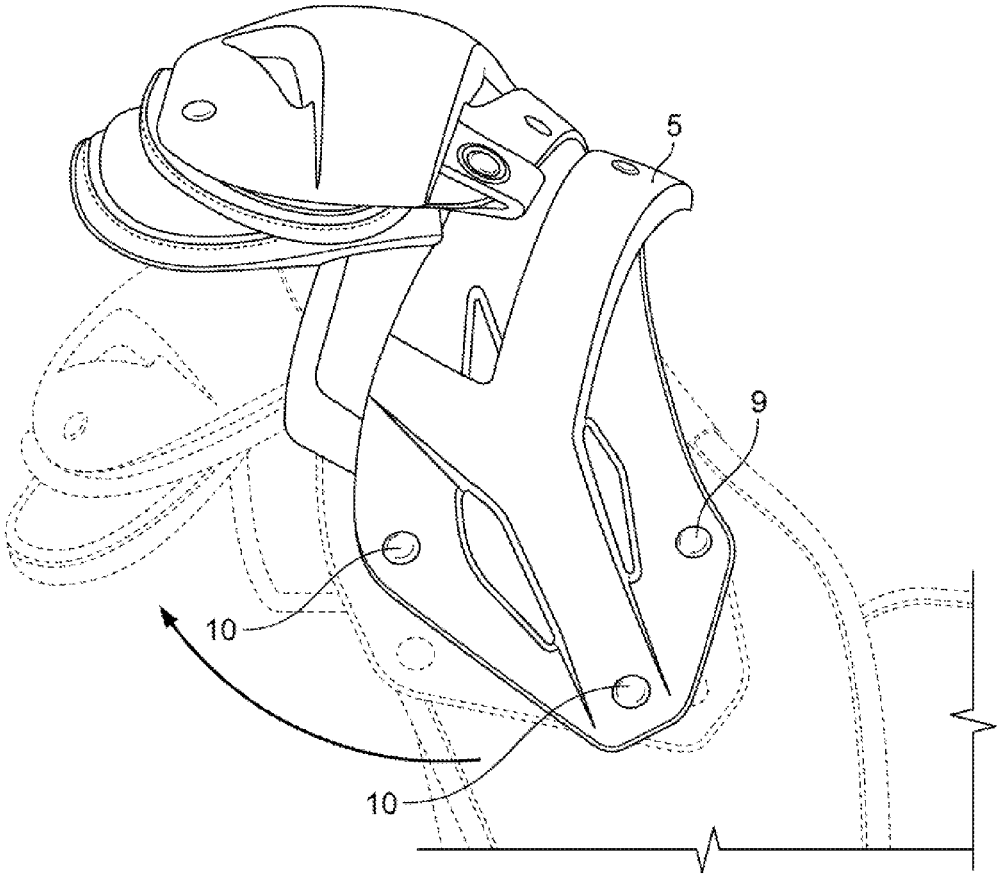
FIG. 5 is a front view of one side of football shoulder pads in accordance with one embodiment of the invention demonstrating rotation of the arch portion relative to the chest portion of the football shoulder pads at a pivot point.

Due to the pivot rivets 9, the arch portion 5 including shoulder portion 4 of the pads rotates 10-20 degrees. In a specific example, the arch portion 5 is rotated 12 degrees. FIG. 5 shows one embodiment in which the arch portion 5 is rotated. This rotation of the arch portion 5 and shoulder portion 4 provides a significant improvement over conventional shoulder pads, specifically for activities which require raising of arms (e.g., catching a football).

Pivoting rivets 9 are installed in such manner that it allows the arch portion 5 to rotate in the holes formed in the internal parts of the pad. The internal parts consist of punched out polyethylene sheets and fabric pieces that form the inner protective zones in the pad.

According to another embodiment, arch rotation from a main sternum/breast plate of the pad results from, for example, a stretch connector feature. Conventional shoulder pad designs do not include such stretch connector feature.

Another aspect of the invention is the method of forming components of the shoulder pads and materials for components of the shoulder pads which provide an impact modifier feature. The plastic components of the shoulder pads are preferably formed by injection molding rather than compression molding.

The plastic components that may be formed by injection molding include, for example, the lower back plate, belt cover, buckle, front lower plate, bicep cap, epaulet, arch plate, and back plate. In one embodiment, a reinforced epaulet cap (shoulder) is used. The epaulet cap is reinforced by adding plastic thickness in some locations, increasing radiuses and fillets, and removing (e.g., filling) webbing slots.

In one embodiment, the arch portion 5 is formed by injection molding rather than compression molding. In conventional shoulder pads, an arch component is formed by compression molding. The component starts as a flat sheet of material and is put in an open heated mold which is then closed and is subjected to pressure. The combination of heat and pressure forms the product into the desired shape. Then the heat is reduced and the pressure is taken off and the component cools in the shape formed by the mold. However, compression molded components have a tendency to return to their original state, i.e., a flat sheet. Thus, for an arch component in conventional shoulder pads, many rivets are required to firmly secure the arch to the shoulder pads.

With injection molding, a material which is typically in pellet or granule form is heated in a tube or barrel into a soft form and then forced into a mold cavity. The material is cooled in its new form and is released from the mold resulting in the component having the desired shape such as arch portion 5. Thus, the original shape of the injection molded component is the desired shape of the component and there is no tendency for the component to flatten out as with compression molding. This allows, for example, for the arch portion 5 to be attached to the chest portion 2 and the back portion 3 with a single rivet each (pivot rivets 9) and to provide the pivot feature of the arch portion 5 giving a wide range of motion for a user wearing the shoulder pads of the invention. In addition, since the injection molding process starts with material in pellet or granule form, additional materials such as glass can be added to the material to increase the strength of the component to prevent cracking and protect users from impacts such as when playing football.

Materials used for components of the shoulder pads such as the arch increase the strength and reduce potential cracking. For example, the material injected into the mold to form components such as the arch comprises fiberglass and polyethylene (or polypropylene). A range of 5-15% of fiberglass is preferred and a range of 85-95% of polyethylene and/or polypropylene is preferred. For example, 5% fiberglass and 95% polypropylene may be used at injection time.

Combining fiberglass and resin at this proportion has not be done to form components in conventional shoulder pads.

The arches combine for approximately 12% of the total pad weight, which is an improvement over the conventional heavier designs. The total weight of the plastic components is approximately 36% of the total pad weight, which is an improvement over the conventional designs. And the approximate average weight of the shoulder pads is less than 5 lbs.

The shoulder pads of the invention also include a pad-lock buckle system 12 for securing a belt 7 from the back portion 2 to the chest portion 3 on the left torso portion and on the right torso portion. The pad-lock buckle system 12 of the invention makes it easier for the user to adjust the pads and take on and off the pads before and after use.

In one embodiment, the pad-lock design is a tongue-and-groove design. In FIG. 1, the buckles 6 are engaged in a receiving portion 11. Each belt 7 is attached at one end to the back portion of the shoulder pads and at the other end to the buckle 6. The belt 7 is made of for example, a nylon material (e.g., one non-limiting example is a nylon automotive grade non-stretchable web strapping material). The buckle 6 is configured to lock in the receiving portion 11 formed on the chest portion 2 of the shoulder pads 1.

Figure 6:
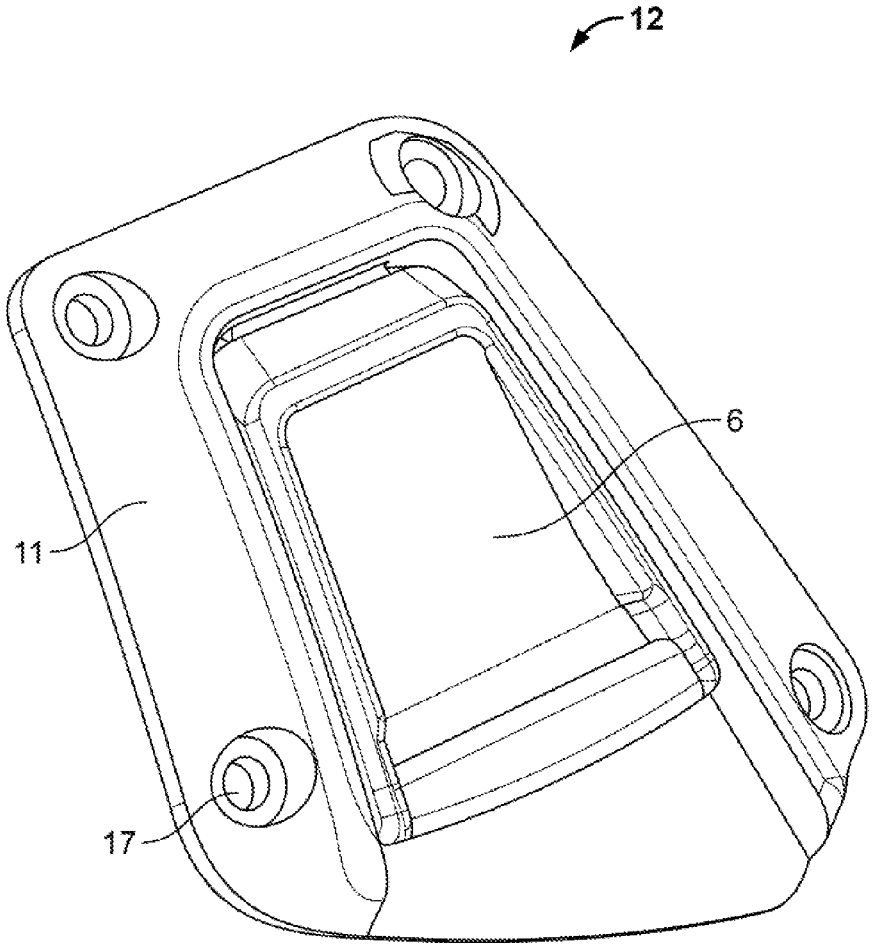
FIG. 6 is a top perspective view of the buckle system for football shoulder pads in accordance with one embodiment of the invention.
Figure 7A:
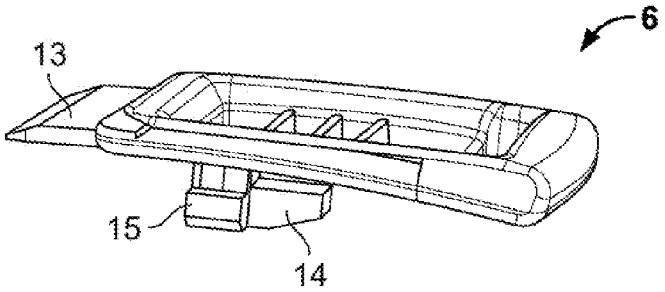
FIGS. 7A-7C are views of the buckle in accordance with one embodiment of the invention.
Figure 7B:
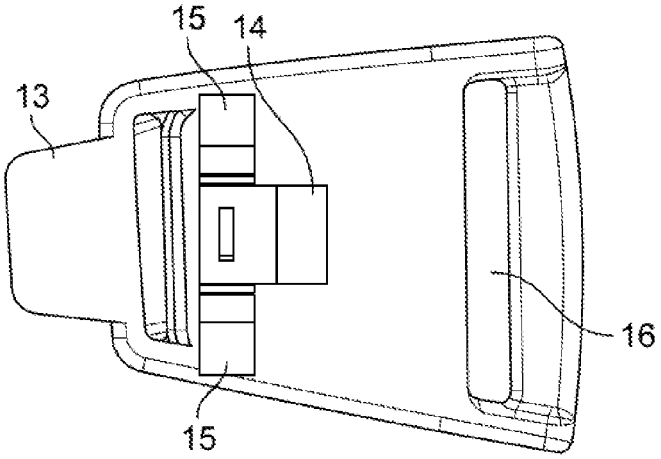
Figure 7C:
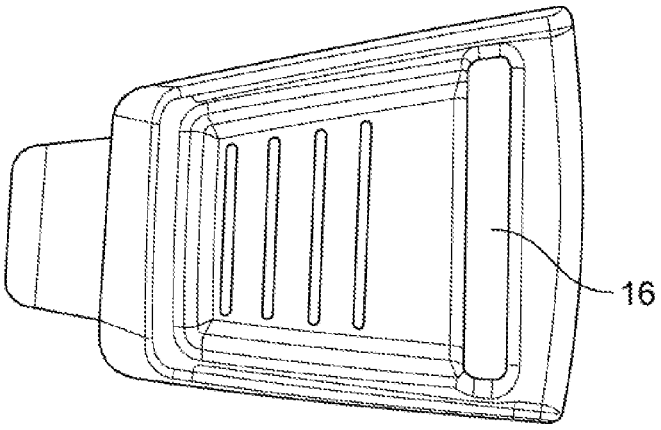

FIG. 6 provides a view of the buckle system 12 in which the buckle 6 is provided in the receiving portion 11. In FIG. 6, the buckle system is shown without belt 7. FIGS. 7A-7D provide several views of the buckle 6. The buckle 6 includes a tongue portion 13 at the front of the buckle. Tongue portion 13 helps to align and guide the buckle into the receiving portion 11. Buckle 6 also includes a protrusion section including an L-shaped middle protrusion 14 at the bottom of the buckle and at the middle portion of the buckle with an approximately 90° bend in an L shape facing towards the back of the buckle and an L-shaped side protrusion 15 on each side of the L-shaped middle protrusion 14, the two L-shaped side protrusions having an approximately 90° bend in an L shape facing in opposite directions and toward the sides of the buckle away from the L-shaped middle protrusion 14 and at approximately a right angle to the L-shaped middle portion. The buckle 6 also includes a belt slot 16 for receiving the belt.

Figure 8:
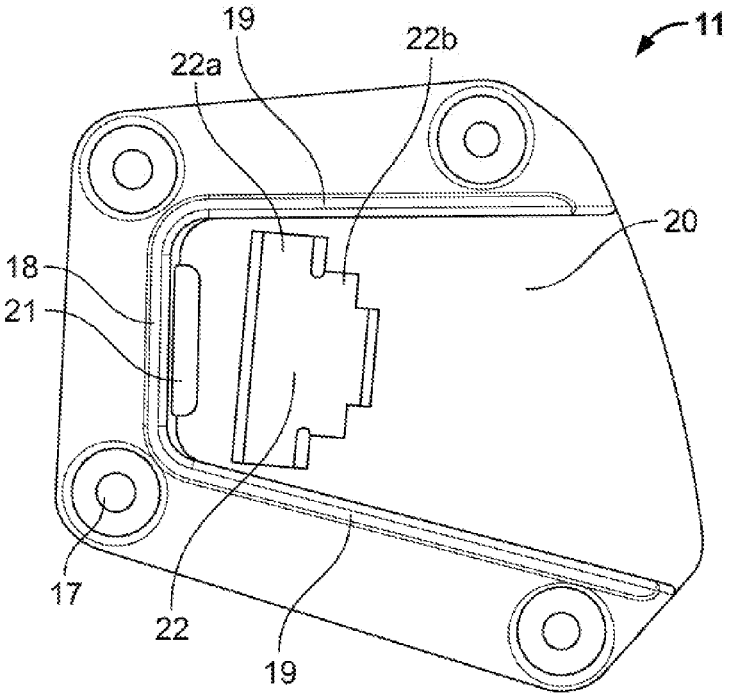
FIG. 8 is a top perspective view of the receiving portion of the buckle system in accordance with one embodiment of the invention.

The receiving portions 11 of the buckle system 12 are secured to the chest portions 2 of the shoulder pads 1 by, e.g., rivets, through holes 17 on the outer periphery of the receiving portion 11. FIG. 8 shows the receiving portion 11 of the buckle system 12. The receiving portion 11 has a front wall 18 and two side walls 19 connected to the front wall 18. The front wall 18 and two side walls 19 form a recess 20 with an opening in the back and in substantially the same shape as the outer peripheral shape of the front and two sides of the buckle 6 for receiving the buckle. A tongue slot 21 is provided at the front of the recess 20 for receiving the tongue 13 of the buckle 6. A stepped cut-out 22 is provided in the recess 20 of the receiving portion 11 to receive the L-shaped middle and side protrusions (14, 15) of the buckle. The stepped cut-out 22 has a wide portion 22*a* for receiving the protrusions (14, 15) of the buckle and a narrower portion 22*b* arranged in a direction opposition from the front wall 18 of the recess 20 to engage with the L-shaped protrusions (14, 15). To engage and lock the buckle 6 to the receiving portion 11, the tongue 13 is inserted into the tongue slot 21 and the buckle 6 is placed flush onto the bottom surface of the recess 20 with the L-shaped protrusions (14, 15) in the wide portion 22*a* of the stepped cut-out 22. Then the buckle 6 is pulled back so that the L-shaped middle and side protrusions (14, 15) engage with respective portions of the narrower portion 22*b* of the stepped cut-out 22 in the recess 20 to securely lock the buckle 6 in the receiving portion 11.

Figure 9:
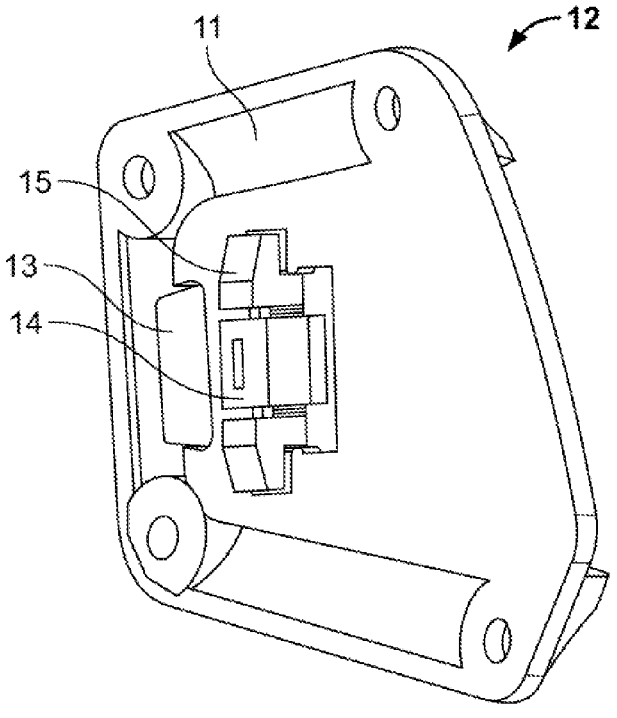
FIG. 9 is a bottom perspective view of the buckle system with the buckle received by the receiving portion of the buckle system in accordance with one embodiment of the invention.
Figure 10:
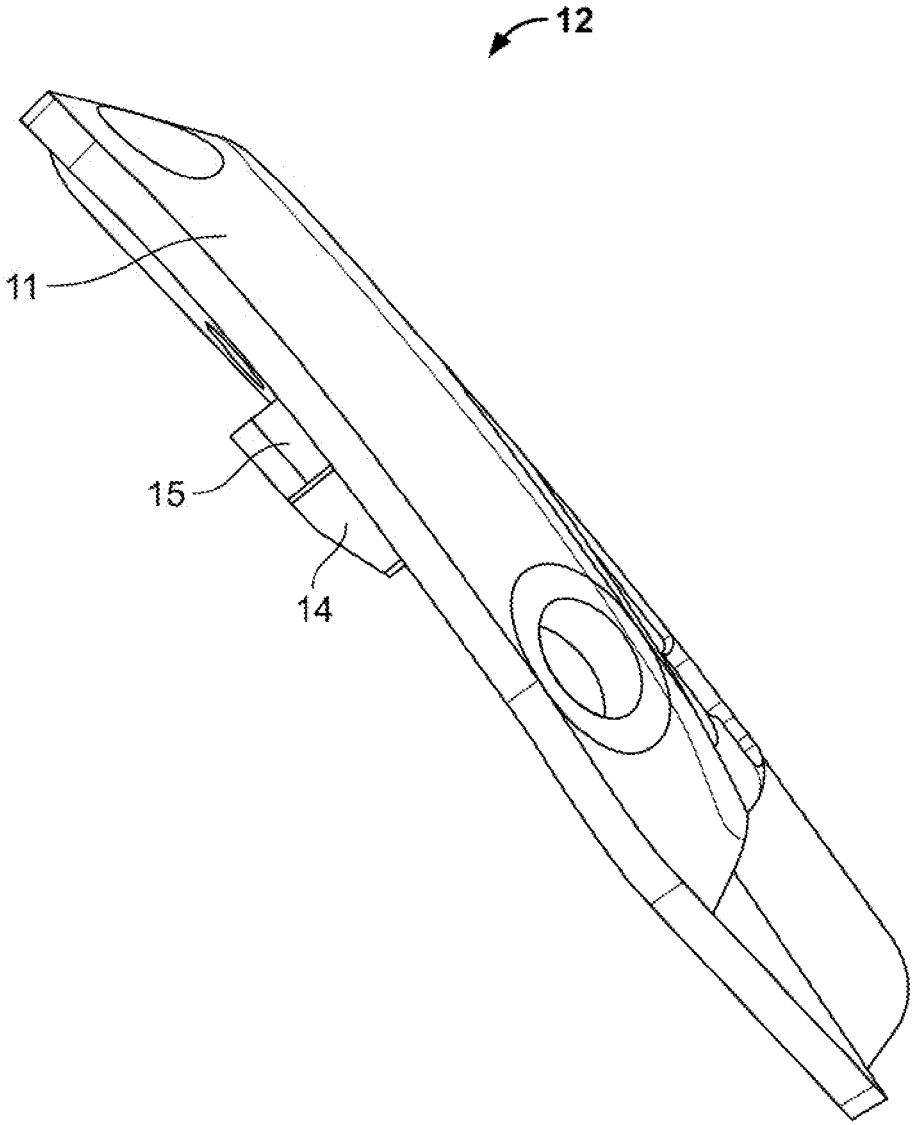
FIG. 10 is a side perspective view of the buckle system with the buckle received by the receiving portion of the buckle system in accordance with one embodiment of the invention.

FIG. 9 shows a bottom view of the buckle system 12 with the buckle 6 provided in the receiving portion 11 and FIG. 10 shows a side view of the buckle system 12 with the buckle 6 provided in the receiving portion 11. As seen in FIGS. 6 and 10, the buckle 6 fits in recess 20 with approximately the same shape and size as recess 20 and has a height that is approximately the same as the front wall 18 and two side walls 19 of recess 20 providing a flat profile. Due to this configuration, the buckle is well protected by the surrounding walls of the recess preventing the possibility of the buckle becoming disengaged with the receiving portion upon an impact such as when playing football. Also with this buckle system 12, the buckle 6 locks into place in the receiving portion 11 for a generally flush mount which reduces and preferably eliminates any grab points. Conventional buckle systems for shoulder pads are bulky and provide easy grab points for, e.g., football opponents, to grab on to.

The shoulder pads 1 may include components made of SAS-TEC foam. SAS-TEC foam provides improved protection even when compressed. Conventional shoulder pads include foams that lose protection ability the more the pad is compressed and do not include SAS-TEC foam. According to one embodiment, SAS-TEC foam is provided at a location resulting in the greatest impact while the shoulder pad is being used, e.g., beneath arch components.

The shoulder pads 1 may include compressed hex foam on the inner portion of the shoulder pads which promotes airflow, moisture evaporation and cooling performance due to a plurality of 3D lateral channels and perforations formed therein. One advantage of the compressed hex foam is that it provides extra protection while maintaining flexibility. The compressed hex foam may be used in, for example, a sternum and spine pad. In one embodiment, compressed HEX foam is used in a comfort liner which is removable, e.g., for washing and drying.

The shoulder pads may include the "Z-Cool" foam padding which is an improvement of the foam padding disclosed in U.S. Pat. No. 7,168,104 which is incorporated herein by reference. The foam padding used in the shoulder pads (e.g., one non-limiting example is Brock™ foam padding) serves at least the following purposes: first, the waterproof foam beads allow for 3-D air circulation, which enhances evaporation, second, the thousands of tiny foam beads used in the padding absorb energy by transferring the force of impact to each successive and surrounding beads thereby lessening the force transferred and absorbed by the body.

According to one embodiment, this high impact perforated, inner poly arch design is sandwiched between dual layers of perforated EVA and Closed Cell Foams.

The shoulder pads may include separate padding selectively removable from the shoulder pads through Velcro™. The shoulder pads may also have selectively removable additional pads, such as left and right deltoid pads and attachments for securing football pad accessories, such as a neck roll or rib protector, to the shoulder pads. Perforated closed cell foam clavical pads and EVA foam deltoid pads can be positioned or removed for precise fit and coverage in the key impact areas.

Figure 12:
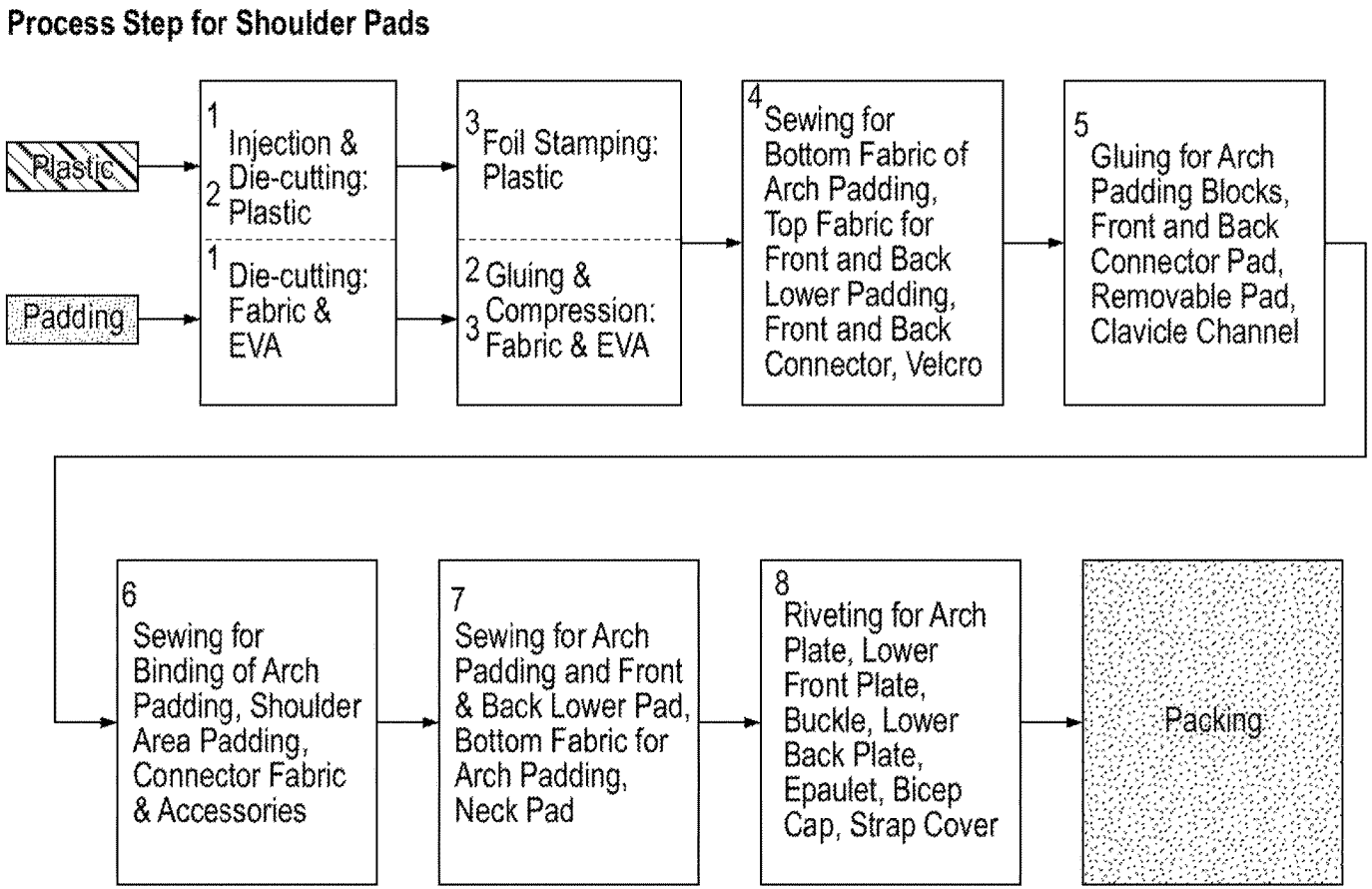
FIG. 12 is a flow diagram showing the process for manufacturing shoulder pads in accordance with one embodiment of the invention.

FIGS. 11 and 12 show the process for manufacturing the shoulder pads. As shown in FIG. 11, the process includes Part 1 which refers to the plastic components and Part 2 which refers to the Padding & Assembly. Part 1 includes (1) injection, (2) die-cutting & trimming, and (3) Foil Stamping. Part 2 includes (1) die-cutting, (2) gluing, (3) compression, (4) sewing, (5) gluing, (6) binding sewing, (7) sewing and (8) rivet punching.

FIG. 12 shows that steps (1)-(3) of Part 1 (Plastic) may be performed in parallel with steps (1)-(3) of Part 2 (Padding & Assembly).

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. Shoulder pads, comprising:

a left torso pad and a right torso pad, each of the left and right torso pads including a chest portion, a back portion, and an arch portion, wherein each arch portion extends from a first end thereof to a second end thereof that is opposite of the first end;

wherein the first end of each arch portion is pivotably connected to the respective chest portion by a first fastener extending at least partially within a first opening in the arch portion, the first fastener being configured for movement relative to the first opening, wherein the second end of each arch portion is pivotably connected to the respective back portion by a second fastener extending at least partially within a second opening in the arch portion, the second fastener being configured for movement relative to the second opening, and wherein each arch portion is configured to rotate independently of the respective chest and back portions via the pivotable connections of the arch portion.

2. The shoulder pads of claim 1, wherein each of the left and right torso pads further comprises:

a shoulder portion that is fastened to the respective arch portion and is pivotably connected to the respective chest portion and back portion at the same pivotable connection as the respective arch portion.

3. The shoulder pads of claim 1, wherein each arch portion includes:

at least one additional connection to the respective chest and back portions by a flexible material configured to permit the rotation of the arch portion at the pivotable connections.

4. The shoulder pads of claim 1, wherein each arch portion is configured to rotate by an angle of between 10 degrees and 20 degrees.

5. The shoulder pads of claim 1, wherein the first fastener and second fastener are rotatable rivets.

6. The shoulder pads of claim 1, wherein the arch portions are plastic components that are injection molded in an arch shape.

7. The shoulder pads of claim 1, wherein the arch portions comprise fiberglass and at least one of polyethylene or polypropylene, and wherein at least one of the arch portions includes an amount of fiberglass between 5% and 15% by weight.

8. The shoulder pads of claim 1, wherein the first fastener of each arch portion is configured to rotate relative to the respective first opening, and wherein the second fastener of each arch portion is configured to rotate relative to the respective second opening.

9. The shoulder pads of claim 1, wherein the first fastener of each arch portion is configured to contact the respective chest portion while the arch portion rotates relative to the chest portion, and wherein the second fastener of each arch portion is configured to contact the respective back portion while the arch portion rotates relative to the back portion.

10. The shoulder pads of claim 1, wherein at least one of the arch portions comprises:

three first end openings in the first end of the at least one arch portion, the first end openings including the first opening and configured to receive fasteners therein, wherein the first end openings are arranged in a triangular configuration; and three second end openings in the second end of the at least one arch portion, the second end openings including the second opening and configured to receive fasteners therein, wherein the second end openings are arranged in a triangular configuration.

* * * * *